US007419070B2

(12) United States Patent
Cantwell et al.

(10) Patent No.: US 7,419,070 B2
(45) Date of Patent: Sep. 2, 2008

(54) INTEGRATED BEVERAGE HOLDER

(75) Inventors: Robert Cantwell, Leslie, MO (US); Arvin Patel, Sunnyvale, CA (US)

(73) Assignee: North Pole Limited, Kowloon (HK)

( * ) Notice: Subject to any disclaimer, the term of this patent is extended or adjusted under 35 U.S.C. 154(b) by 0 days.

(21) Appl. No.: 10/686,991

(22) Filed: Oct. 15, 2003

(65) Prior Publication Data

US 2005/0082303 A1 Apr. 21, 2005

(51) Int. Cl.
*B65D 25/00* (2006.01)

(52) U.S. Cl. ..... 220/739; 220/592.01; 220/915.2; 62/457.4

(58) Field of Classification Search ..... 220/737, 220/739, 915.1, 915.2, 902, 903, 592.01, 220/592.03, 592.16; 62/457.1, 457.4, 457.7, 62/457.2, 457.5, 457.6; 206/545, 549
See application file for complete search history.

(56) References Cited

U.S. PATENT DOCUMENTS 2,880,902 A * 4/1959 Owsen ..... 220/8
5,350,081 A * 9/1994 Graham ..... 220/737
5,505,307 A * 4/1996 Shink ..... 206/541
5,511,755 A * 4/1996 Spykerman ..... 248/311.2
5,842,571 A * 12/1998 Rausch ..... 206/549
D408,225 S 4/1999 Hodosh
5,924,303 A 7/1999 Hodosh
6,067,816 A 5/2000 Hodosh
6,116,045 A * 9/2000 Hodosh et al. ..... 62/457.4
6,363,739 B1 * 4/2002 Hodosh et al. ..... 62/457.4
6,364,329 B1 * 4/2002 Holub et al. ..... 280/47.26
6,481,239 B2 * 11/2002 Hodosh et al. ..... 62/457.4
6,834,838 B2 * 12/2004 Dennis et al. ..... 248/311.2
2005/0072181 A1 * 4/2005 Mogil et al. ..... 62/457.7

* cited by examiner

*Primary Examiner*—Anthony D Stashick
*Assistant Examiner*—Harry A Grosso
(74) *Attorney, Agent, or Firm*—Armstrong Teasdale LLP

(57) ABSTRACT

An insulated container includes a body, a cover and an expandable beverage holder. The body includes outer walls and a base to define a storage space and to prevent heat transfer out of the storage space. The cover is configured to couple with the body and to prevent heat transfer out of the storage space. The expandable beverage holder is configured to couple to the cover and to hold a beverage container when expanded.

11 Claims, 4 Drawing Sheets

INTEGRATED BEVERAGE HOLDER

FIELD

The present invention relates to insulated containers generally and more particularly to insulated containers with beverage holders.

BACKGROUND

Insulated food and beverage containers or 'coolers' are very common among American households. They can most often be seen on trips to a picnic or the beach. A problem with picnics is finding a place to put down the beverage container on a level location. Anyone who has ever been there knows the problem with having beverages at the beach. That is, sand gets blown and/or kicked into the beverage containers. To provide a level surface and to prevent sand from entering the beverage containers, many coolers have been designed with beverage holders to elevate the cup, soda can or bottle off of the sandy ground.

While cooler mounted beverage holders may alleviate some problems, conventional beverage holders create new problems for the cooler user. For example, typically the beverage holder extends into the cooler storage space even when the beverage holder is not in use. Hence, less food and/or drinks can be packed into the cooler and transported to the desired destination. A further problem is that the beverage holder affords no cooling to the beverage.

Therefore, an improved cooler mounted beverage holder is needed.

SUMMARY

An insulated container includes a body, a cover and an expandable beverage holder. The body includes outer walls and a base to define a storage space and to prevent heat transfer out of the storage space. The cover is configured to couple with the body and to prevent heat transfer out of the storage space. The expandable beverage holder is configured to couple to the cover and to hold a beverage container when expanded.

In one aspect of the invention, the expandable beverage holder is configured to extend away from the storage space when expanded.

In another aspect of the invention, the expandable beverage holder is configured to extend into the storage space when expanded.

In another aspect of the invention, bottom of the expandable beverage holder is configured to prevent heat transfer.

In another aspect of the invention, sides of the expandable beverage holder are configured to allow heat transfer.

In another aspect of the invention, the body and the cover of the insulated container are soft-sided.

DETAILED DESCRIPTION

Figure 1:
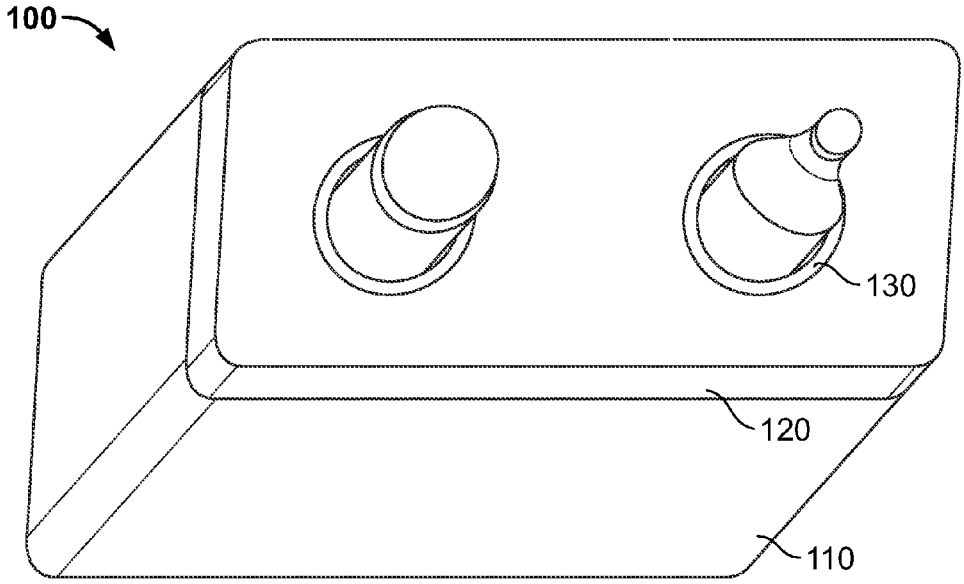
FIG. 1 is a perspective view showing an insulated container with an integrated beverage holder, according to one embodiment of the present invention.

FIG. 1 is a perspective view showing an insulated container with an integrated beverage holder 100, according to one embodiment of the present invention. The insulated container with an integrated beverage holder includes a body 110, a cover 120, and an expandable beverage holder 130. In one embodiment, the body comprises outer walls and a base to define a storage space for storing food and drinks. The outer walls and base of the body are also configured to prevent heat transfer out of the storage space. The cover is configured to couple with the body and to prevent heat transfer out of the storage space. The expandable beverage holder is configured to couple to the cover and to hold a beverage container when expanded. The expandable beverage holder is one type of integrated beverage holder in accordance with the invention. The expandable beverage holder may be used to hold a can, bottle and/or other types of beverage containers or items.

In one aspect, the expandable beverage holder 130 is expanded using a telescoping construction. In another aspect, the expandable beverage holder is expanded using an extending, snapping, and/or popping construction. These beverage holder constructions are exemplary only and the beverage holder may be of any suitable construction.

In one aspect, coupling of the body 110 to the cover 120 includes a zipper. In another aspect, the coupling of the body to the cover includes a snap. In yet another aspect, the coupling of the body to the cover includes a hinge. These body-cover couplings are exemplary only and the body-cover coupling may be any suitable type of coupling.

In one aspect, the body 110 and the cover 120 are soft-sided. In another aspect, the body and the cover are hard-sided. The body and/or cover, however, may be constructed of any suitable material and is not limited to hard and soft materials.

Figure 2:
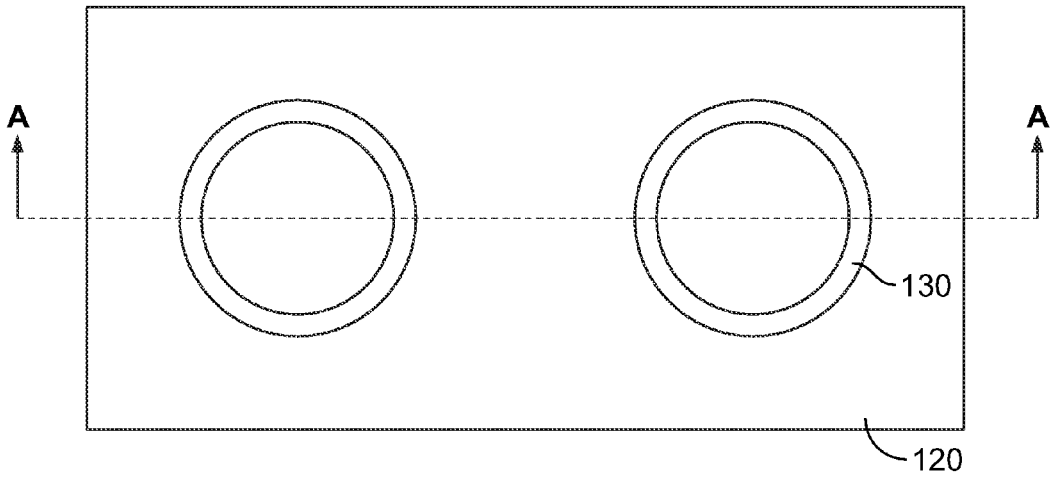
FIG. 2 is a top view of an integrated beverage holder coupled to the cover of an insulated container (cover-beverage holder combination), according to one embodiment of the present invention.

FIG. 2 is a top view of an integrated beverage holder coupled to the cover of the insulated container (cover-beverage holder combination), according to one embodiment of the present invention. In this embodiment, the expandable beverage holder 130 is coupled to or 'integrated' into the cover 120. Line A-A is applied in FIGS. 3-6 below.

Figure 3:
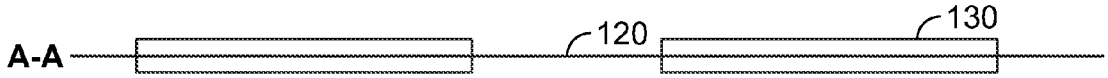
FIG. 3 is a sectional view of the cover-beverage holder combination depicted in FIG. 2, where the expandable beverage holder is in a collapsed position, according to one embodiment of the invention.

FIG. 3 is a sectional view of the cover-beverage holder combination depicted in FIG. 2, where the expandable beverage holder is in a collapsed position, according to one embodiment of the invention. The cover-beverage holder combination includes the cover 120 and the expandable beverage holder 130. In the embodiment depicted in FIG. 3, the expandable beverage holder is configured to extend away from the storage space when expanded. Thus, in one aspect, the collapsed expandable beverage holder lies partially above the cover 120 so that the expandable beverage holder can extend away from the storage space when expanded.

Figure 4:
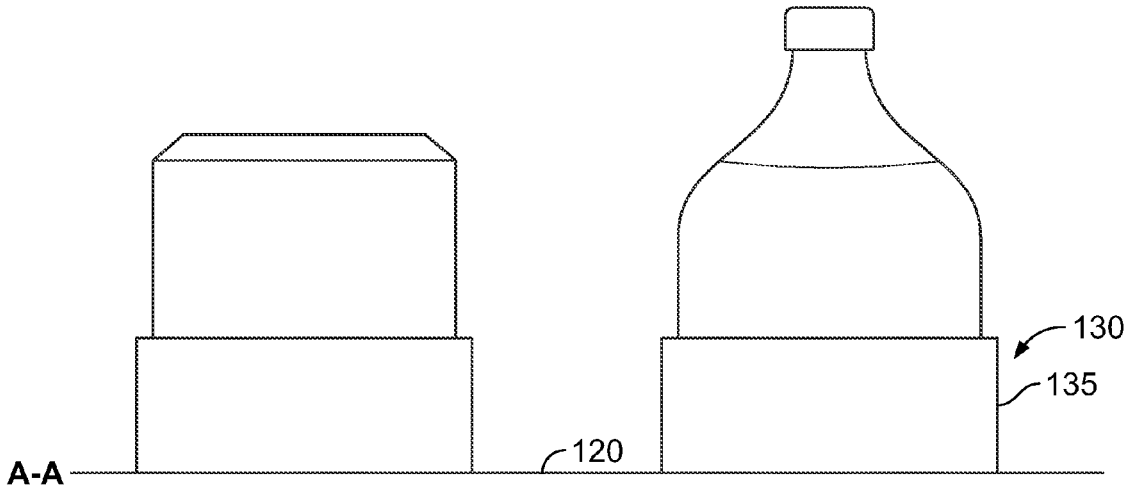
FIG. 4 is a sectional view of the cover-beverage holder combination depicted in FIG. 3, where the expandable beverage holder is in an expanded position, according to one embodiment of the invention.

FIG. 4 is a sectional view of the cover-beverage holder combination depicted in FIG. 3, where the expandable beverage holder is in an expanded position, according to one embodiment of the invention. The cover-beverage holder combination includes the cover 120 and the expandable beverage holder 130. The expandable beverage holder includes beverage holder sides (sides) 135.

Figure 7:
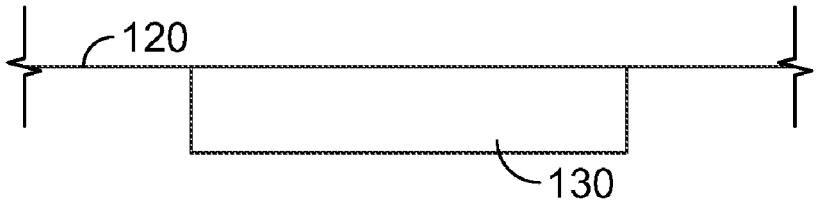
FIG. 7 is a cross-sectional view of the cover-beverage holder combination, which may be used with the insulated container shown in FIG. 1, including the expandable beverage holder in a collapsed position.
Figure 8:
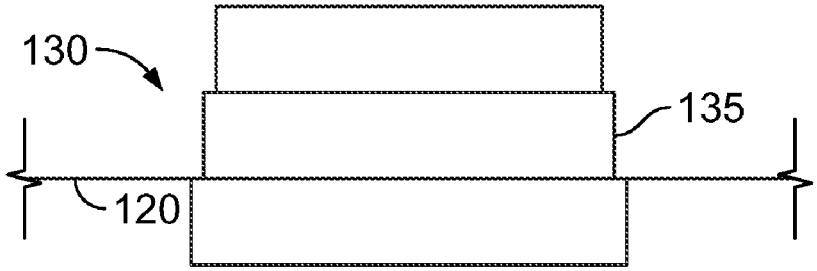
FIG. 8 is a cross-sectional view of the expandable beverage holder shown in FIG. 7 expanded upwardly with respect to the cover.

In one aspect, the beverage holder sides 135 are pulled away from the cover 120 so that the sides telescope upwards (away from the storage space), forming the beverage holder, as shown in FIG. 8. To collapse the beverage holder, the sides may be compressed, as shown in FIG. 7. In another aspect, the beverage holder may be locked in an 'upright' or 'deployed' position.

Figure 5:
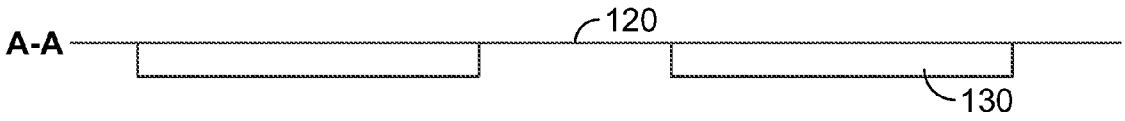
FIG. 5 is a sectional view of the cover-beverage holder combination depicted in FIG. 2, where the expandable beverage holder is in a collapsed position, according to another embodiment of the invention.

FIG. 5 is a sectional view of the cover-beverage holder combination depicted in FIG. 2, where the expandable beverage holder is in a collapsed position, according to another embodiment of the invention. The cover-beverage holder combination includes the cover 120 and the expandable beverage holder 130. In the embodiment depicted in FIG. 5, the expandable beverage holder is configured to extend into the storage space when expanded. Thus, in one aspect, the collapsed expandable beverage holder lies below or partially below the cover 120 so that the expandable beverage holder can extend into the storage space when expanded.

Figure 6:
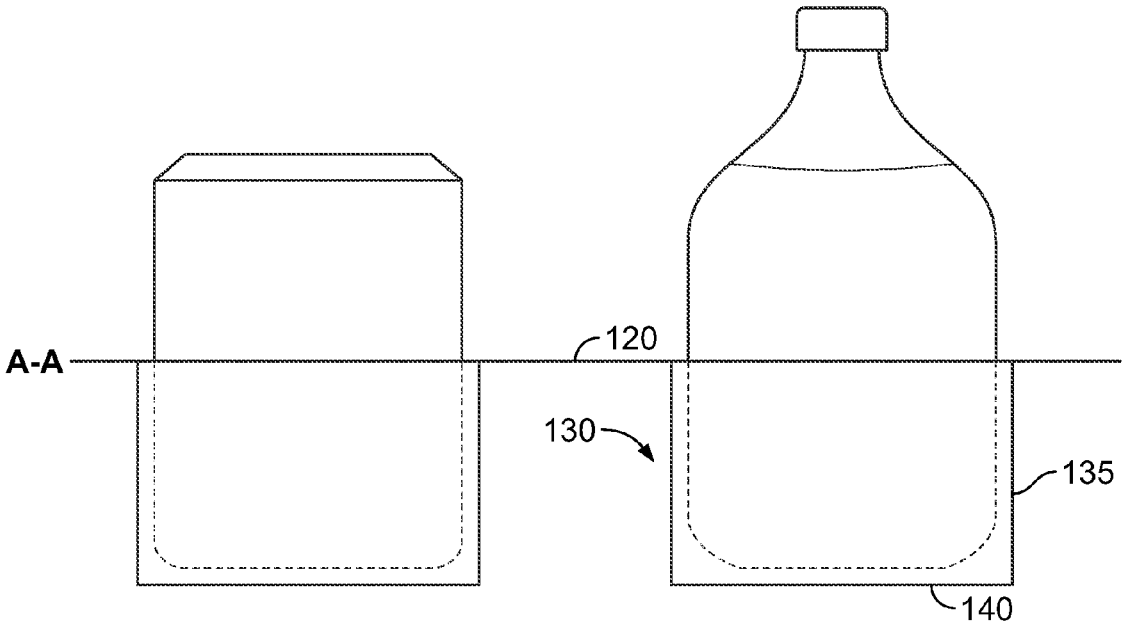
FIG. 6 is a sectional view of the cover-beverage holder combination depicted in FIG. 5, where the expandable beverage holder is in an expanded position, according to one embodiment of the invention.

FIG. 6 is a sectional view of the cover-beverage holder combination depicted in FIG. 5, where the expandable beverage holder is in an expanded position, according to one embodiment of the invention. The cover-beverage holder combination includes the cover 120 and the expandable beverage holder 130. The expandable beverage holder includes the beverage holder sides 135 and a beverage holder bottom (bottom) 140.

In one aspect, the beverage holder bottom 140 is configured to prevent heat transfer out of the storage space. In another aspect, the beverage holder sides 135 are configured to allow heat transfer. If the beverage holder bottom prevents heat transfer and the beverage holder sides allow heat transfer then the temperature of the beverage may be better maintained when the beverage container is inserted in the beverage holder. That is, a cold beverage can be kept cool when inserted in the beverage holder, where the temperature of the storage space is colder than outside air; and a hot beverage can be kept warm when inserted in the beverage holder, where the temperature of the storage space is warmer than outside air.

Figure 9:
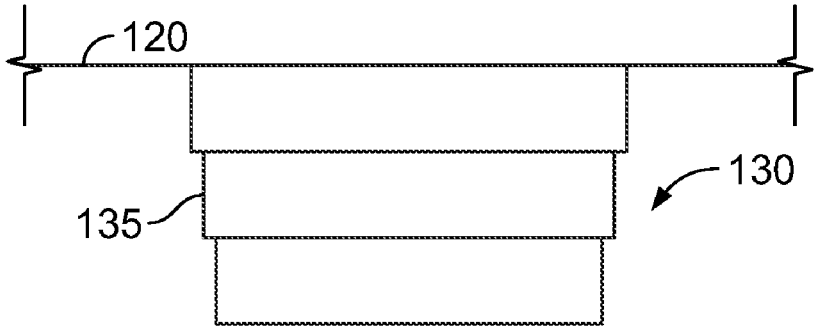
FIG. 9 is a cross-sectional view of the expandable beverage holder shown in FIG. 7 expanded downwardly with respect to the cover.

In one aspect, the beverage holder sides 135 are pulled away from the cover 120 so that the sides telescope downwards (into the storage space), forming the beverage holder, as shown in FIG. 9. To collapse the beverage holder, the sides may be compressed, as shown in FIG. 7. In another aspect, the beverage holder may be locked in a 'deployed' position.

The present invention provides a beverage holder which allows increased storage capacity of insulated containers. The beverage holder also can limit heat transfer out of a beverage container.

Having disclosed exemplary embodiments and the best mode, modifications and variations may be made to the disclosed embodiments while remaining within the subject and spirit of the invention as defined by the following claims.

The invention claimed is:

1. An insulated container comprising:

a body comprising outer walls and a base defining a storage space and configured to prevent heat transfer out of the storage space;

a cover configured to couple with the body and to prevent heat transfer out of the storage space; and an expandable beverage holder configured to couple to the cover, the expandable beverage holder having a telescoping construction and movable between a collapsed configuration and an expanded configuration, in the expanded configuration the expandable beverage holder comprising a side configured to extend into the storage space and configured to hold a beverage container, a bottom of the expandable beverage holder configured to prevent heat transfer.

2. The insulated container of claim 1, wherein a side of the expandable beverage holder is configured to allow heat transfer.

3. The insulated container of claim 1, wherein the body and the cover are soft-sided.

4. The insulated container of claim 1, further comprising at least one of a zipper, a snap and a hinge to facilitate coupling the body to the cover.

5. A container comprising:

an insulated body comprising outer walls and a base, the insulated body defining a storage space;

an insulated cover movably coupled with the insulated body; and an expandable beverage holder integrated with the insulated cover, the expandable beverage holder having a telescoping construction and movable between a collapsed configuration and an expanded configuration, in the expanded configuration the expandable beverage holder comprising a side configured to telescope into the storage space and configured to hold a beverage container.

6. The insulated container of claim 5, wherein the side is configured to telescope away from the storage space to form the beverage holder in the expanded configuration.

7. The insulated container of claim 6, wherein the side is configured to compress to facilitate moving the expandable beverage holder to the collapsed configuration.

8. The insulated container of claim 5, wherein the side is configured to compress to facilitate moving the expandable beverage holder to the collapsed configuration.

9. The container of claim 5, wherein a bottom of the expandable beverage holder is configured to prevent heat transfer.

10. The container of claim 5, wherein the side of the expandable beverage holder is configured to allow heat transfer.

11. An insulated container comprising:

a body comprising outer walls and a base, the body defining a storage space and configured to prevent heat transfer out of the storage space;

a cover configured to couple with the body and to prevent heat transfer out of the storage space; and an expandable beverage holder configured to couple to the cover, the expandable beverage holder having a telescoping construction and movable between a collapsed configuration and an expanded configuration, the expandable beverage holder comprising a side configured to telescope into the storage space in the expanded configuration to hold a beverage container.

* * * * *